US005622219A

United States Patent [19]

Voss et al.

[11] Patent Number: 5,622,219

[45] Date of Patent: Apr. 22, 1997

[54] HIGH EFFICIENCY, SMALL VOLUME EVAPORATOR FOR A REFRIGERANT

[75] Inventors: Mark Voss, Franksville; Gregory Hughes, Milwaukee; Scot Alley; Peter Kottal, both of Racine, all of Wis.

[73] Assignee: Modine Manufacturing Company, Racine, Wis.

[21] Appl. No.: 328,034

[22] Filed: Oct. 24, 1994

[51] Int. Cl.[6] ..... F28F 9/26

[52] U.S. Cl. ..... 165/144; 165/176; 165/178

[58] Field of Search ..... 165/144, 153, 165/151, 173, 174, 175, 176, 178, 145

[56] References Cited

U.S. PATENT DOCUMENTS

| | | | |
|---|---|---|---|
| 2,184,657 | 12/1939 | Young | 165/145 |
| 3,289,755 | 12/1966 | Jacobs | 165/145 |
| 3,782,454 | 1/1974 | Slaasted et al. | 165/144 |
| 3,796,256 | 3/1974 | Foster | 165/151 X |
| 4,295,521 | 10/1981 | Sommars | 165/144 X |
| 5,086,835 | 2/1992 | Shinmura | 165/144 |
| 5,157,944 | 10/1992 | Hughes et al. | 165/144 X |
| 5,203,407 | 4/1993 | Nagasaka | 165/174 |
| 5,205,347 | 4/1993 | Hughes | 165/144 X |
| 5,226,490 | 7/1993 | Ryan et al. | 165/173 |
| 5,363,910 | 11/1994 | Baba et al. | 165/153 |

FOREIGN PATENT DOCUMENTS

| | | | |
|---|---|---|---|
| 414433 | 2/1991 | European Pat. Off. | 165/145 |
| 971392 | 1/1951 | France | 165/176 |
| 322789 | 7/1920 | Germany | 165/174 |
| 2206623 | 8/1972 | Germany | 165/145 |
| 268128 | 9/1992 | Japan | 165/176 |
| 16438 | 6/1927 | Netherlands | 165/144 |

*Primary Examiner*—Leonard R. Leo

*Attorney, Agent, or Firm*—Wood, Phillips, VanSanten, Clark & Mortimer

[57] ABSTRACT

A highly efficient parallel flow evaporator is provided by combining a pair of identical units (10), (12) wherein each includes a pair of identical, parallel, spaced headers (40) each having slots (44) receiving the ends of identical flattened tubes (22). Identical tanks (42) are bonded to each of the headers (40) and each has an identical central flat surface (52) and an identical, centrally located port (60). Fins (26) extend between adjacent tubes (22) in each unit (10), (12) and an inlet/outlet fixture (32) is bonded to the flat surfaces (52) of one pair of tanks (42) defined by adjacent tanks (42) of both of the units (10),(12). A cross-over fixture (30) is bonded to the flat surfaces (52) of the other pair of tanks (42) defined by the remaining tanks (42) of both of the units (10),(12). The invention minimizes the number of geometrically different parts, provides an improved distributor (140) for refrigerant, provides an improved inlet passage (108) that provides a uniform stream of refrigerant to the distributor (140) and provides for the direction of refrigerant emanating from the cross-over fixture (30) in a direction parallel to the tubes (22) for improved uniformity.

12 Claims, 3 Drawing Sheets

FIG. 1
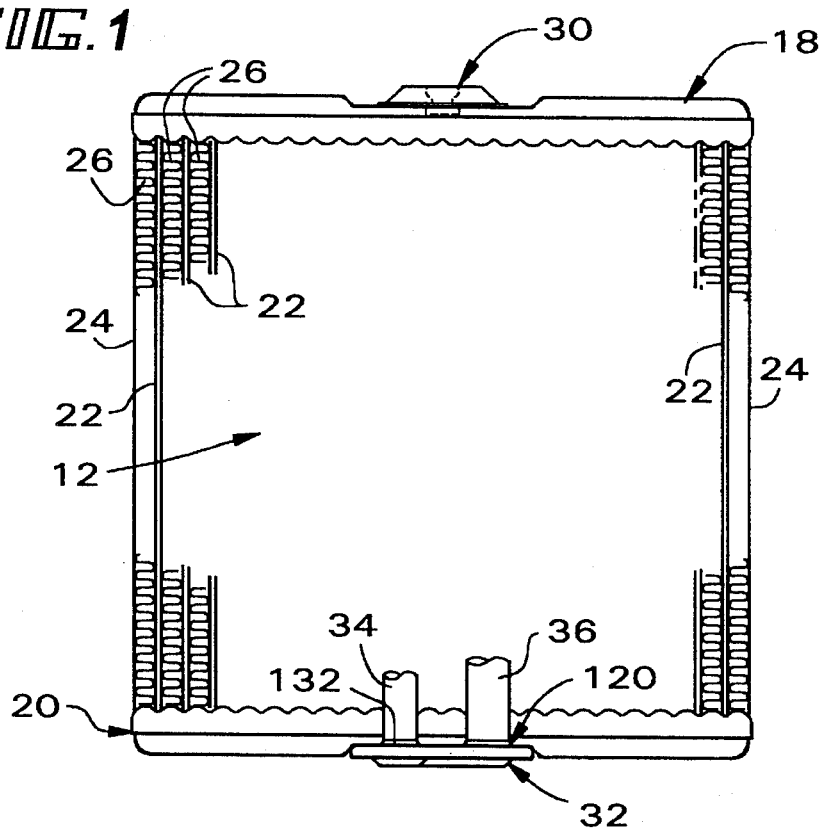
FIG. 2
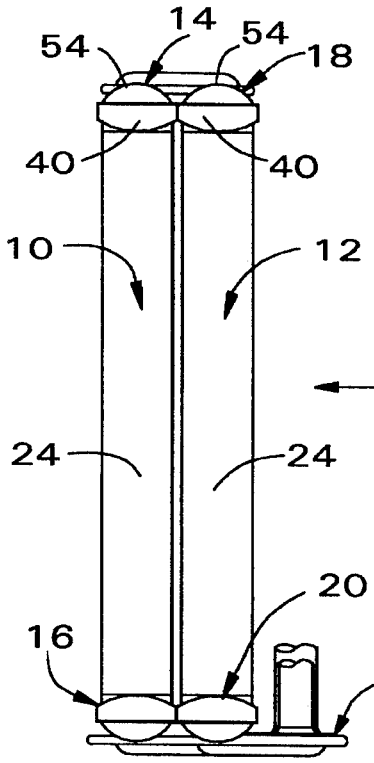
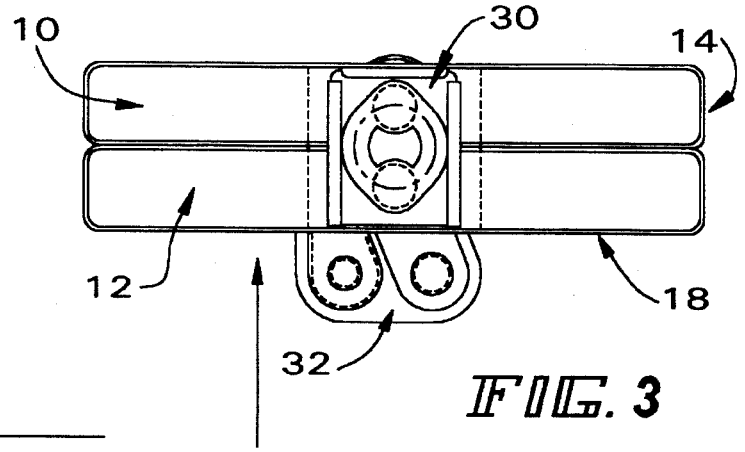
FIG. 3

HIGH EFFICIENCY, SMALL VOLUME EVAPORATOR FOR A REFRIGERANT

FIELD OF THE INVENTION

This invention relates to evaporators for a refrigerant as used in air conditioning and/or refrigeration systems.

BACKGROUND OF THE INVENTION

For many years, air conditioning and/or refrigeration systems (hereinafter collectively referred to as "refrigeration systems" or "air conditioning systems") operating on the vapor compression cycle and employed in vehicular applications utilized rather bulky and inefficient heat exchangers for both the system condenser and the system evaporator. For example, condensers were typically of the serpentine type having a single or occasionally two passes. In order to avoid excessive refrigerant side pressure drops because of the lengths of each run, the refrigerant confining tubing, typically a multi-passage extrusion, had a relatively large tube minor dimension. For any given facial area occupied by the core of the condenser, the relatively large tube minor dimension reduced the air free flow area through the core, thereby inhibiting heat transfer.

Refrigeration system evaporators were generally of three differing types. One type also was a serpentine tube construction using an extruded tube having a tube major dimension that typically was on the order of four inches. The resulting evaporator cores were relatively deep and as a result, air side pressure drop across the evaporator was relatively high and that in turn reduced the amount of air that could be forced through the evaporator and/or required a larger fan and more energy to drive it. The relatively large tube minor dimension of the tubes used in these constructions also affected air side pressure drop adversely, exacerbating the problem. Furthermore, with such a core depth, draining of condensate from the core was difficult. As a result, condensate from the ambient air would further increase the air side pressure drop. In addition, the film of water forming on evaporator parts impeded heat transfer.

Still another type of evaporator more typically found in home refrigeration units as well as in vehicles was a so called round tube plate fin evaporator. These constructions were relatively bulky and because round tubes were utilized, the air side free flow area through the core was decreased considerably, adding to inefficiency of the unit.

Some of these difficulties were cured by resort to so called "drawn cup" evaporators. However, drawn cup evaporators still required a typical core depth of three inches and large minor dimension tubes, and as a consequence, air side pressure drop remained relatively high as did the inefficiencies associated therewith.

In the mid 1980's, so called "parallel flow" condensers began to reach the market for use in automotive air conditioning systems. A typical parallel flow condenser is illustrated in the U.S. Pat. No. 4,998,580 to Guntly and assigned to the same assignee as the instant application. Parallel flow condensers utilize relatively small header and tank constructions that were highly pressure resistant and which had a plurality of flattened tubes extending between parallel headers. The flattened tubes could be either extruded or fabricated with inserts. In either event, each tube had several flow paths extending along the length thereof, each of which were of a relatively small hydraulic diameter, that is, up to about 0.07". Hydraulic diameter is as conventionally defined, that is, four times the cross-sectional area of each flow path divided by the wetted perimeter of that flow path.

Substantial increases in efficiency were immediately noted. Excellent heat transfer was obtained with units that occupied a significantly lesser volume than prior art condensers and which weighed substantially less.

It was surmised that these and other efficiencies might also be obtainable in parallel flow evaporators.

Consequently, work was performed on utilizing parallel flow type constructions with tubes having flow paths of relatively small hydraulic diameter. An example is shown in commonly assigned Hughes Pat. No. 4,829,780, issued May 16, 1989.

This patent recognizes that whereas an efficient parallel flow condenser can be achieved using a single tube row core, to obtain a high efficiency evaporator, multiple tube rows may be required. It has also been determined that the multiple tube rows should be connected to provide a multi-pass arrangement such that the refrigerant passes two or more times across the path of air flow through the evaporator. As taught by Hughes in commonly assigned U.S. Pat. No. 5,205,347, issued Apr. 27, 1993, a counter-cross flow refrigerant flow is highly desirable. In an example of one such evaporator, two tube rows are employed. In the direction of air flow through the resulting core, refrigerant is inleted to the downstream most one of the tube rows to flow therethrough. After that is accomplished, the refrigerant is directed by a cross-over passage to the forward most one of the tube rows and then once again passed across the path of ambient air travel to be outleted.

These evaporators have worked very well for their intended purpose. For a given frontal area, the same heat transfer can be obtained with a far lesser air side pressure drop in a parallel flow evaporator than in either a serpentine evaporator or a drawn cup evaporator. Furthermore, when intended for use in vehicular air conditioning systems, a parallel flow evaporator has a decided advantage because of its low volume. As is well known, an air conditioning evaporator in an automobile is typically housed under the dash. With increasing emphasis on equipping automobiles with air bags, under dash space is at a premium. A typical parallel flow evaporator with the same efficiency as a drawn cup or serpentine evaporator and having the same frontal area can be made with a core depth of about two inches whereas a typical serpentine evaporator would require a four inch core depth and a drawn cup evaporator would require a three inch core depth.

Not only does the parallel flow evaporator drastically reduce the volume required, leaving more space under the dash available for other equipment, the far lesser core depth translates to lesser air side pressure drop and increased efficiency either in terms of being able to have a given fan transfer more air through the core to provide greater efficiency, or in allowing a smaller fan to be used, thereby reducing energy requirements for the fan, or both.

Moreover, the lesser core depth of a parallel flow evaporator facilitates better drainage of condensate, thereby promoting efficiency on that score as well.

The lesser volume translates to lesser weight which is an advantage as far as vehicle fuel economy is concerned. It also translates to a lesser material cost, thereby providing a cost advantage over conventional evaporators.

While the evaporators of the Hughes patents identified above have been very successful, they are not without their faults. For example, distribution of refrigerant in an evaporator is extremely important if maximum efficiency is to be obtained. Consequently, distributors are utilized on the inlet side. One such distributor is shown in the previously identified Hughes No. '347 patent and works well for its intended purpose. However, because it is a threaded fitting and basically requires machining of its internal passages, it is an expensive component that greatly adds to the cost of the evaporator.

Furthermore, refrigerant distribution in a cross over between the first and the second pass of the core is of substantial significance as well.

Also of importance is assuring that the incoming stream of refrigerant is uniform at the time it is delivered to the distributor. In a typical case, the refrigerant has already passed through an expansion valve or a capillary and is at a reduced pressure, and therefore, boiling. If uniformity in the incoming stream is not maintained at this time, the liquid refrigerant may tend to separate from the gaseous refrigerant and maldistribution, with accompanying inefficiency, will result.

Finally, it is highly desirable that such an evaporator be relatively simply made with a minimal number of parts so as to be of extremely economical construction to facilitate wide spread use thereof.

The present invention is directed to achieving one or more of the above objects and/or overcoming one or more of the above problems.

SUMMARY OF THE INVENTION

It is the principal object of the invention to provide a new and improved evaporator for a refrigerant. More particularly, it is an object of the invention, in one facet thereof, to provide an economically manufactured multi-pass evaporator.

It is also an object of the invention, in another facet thereof, to provide an inexpensively fabricated highly efficient distributor for use at the inlet of an evaporator.

It is also an object of the invention, in still another facet thereof, to provide an inlet flow passage for an evaporator that promotes uniformity of the incoming refrigerant flow. It is also an object of the invention in a further facet thereof to provide a highly efficient cross-over between passes in a multi-pass evaporator.

According to the invention, one object of the same is achieved in a parallel flow evaporator that includes a pair of identical modules. Each module includes a pair of identical, parallel spaced headers. Each of the headers has slots with the slots in one being aligned with the slots in the other and a plurality of identical flattened tubes extend in parallel between the headers and have their ends received in aligned ones of the slots and bonded to the respective header. A pair of identical tanks are provided and one is bonded to each header. The tanks each have an identical, central flat surface on the side thereof remote from the header and an identical, centrally located port in its flat surface. The modules are disposed in side by side relation with corresponding tanks and/or headers being in contacting or almost contacting relation. Fins extend between adjacent tubes in each module and an inlet/outlet fixture is bonded to the flat surfaces of one pair of tanks defined by adjacent tanks of both of the modules and has an inlet port in fluid communication with one of the identical ports in the one pair of tanks. It also has an outlet port in fluid communication with the other of the identical ports in such pair of tanks. A cross-over fixture is bonded to the flat surfaces of the other pair of tanks defined by the remaining tanks of both of the modules and has a first port in fluid communication with one of the identical ports in the other pair, a second port in fluid communication with the other of the identical ports in the other pair and a fluid passage interconnecting the first and second ports.

Because of the identity of the headers, the tanks, the tubes, etc., the number of parts required is minimized. Furthermore, by locating the identical ports in central flats, the location of one core with respect to another can be readily interchanged without impeding assembly or resulting in an improperly assembled evaporator.

In a preferred embodiment, the inlet/outlet fixture includes a sheet metal component having a flat surface abutting the tanks of the first pair. A dimple of a size about that of one of the identical ports or less is formed in the sheet metal component and located within one of the identical ports in the one pair of tanks. The dimple includes oppositely directed tabs struck from the dimple to define oppositely directed distributor openings to thereby provide an inexpensive, but highly efficient, refrigerant distributor. In one embodiment of the invention, the inlet/outlet fixture includes an inlet port aligned with one of the identical ports in the one pair of tanks and a further port adapted to be connected to a source of heat exchange fluid. A passage connects the inlet port and the further port and the passage has a diminishing cross-section from the further port extending to an increasing cross-section at or just before the inlet port. The converging of the passage prevents separation of the inlet stream of boiling refrigerant into liquid and vapor fractions, thereby providing uniformity of such stream at the time it reaches the distributor.

According to another facet of the invention, the cross over fixture is constructed so that the first and second ports are generally parallel to the adjacent ones of the headers bonded to the tanks in the other pair of tanks so that a heat exchange fluid emanating from either the first or second port will be flowing to impinge at a nominal right angle on the associated header. Stated another way, the flow will be generally parallel to the direction of the flattened tubes to promote good distribution as the fluid moves from one pass to the other.

According to another facet of the invention, an evaporator for a refrigerant is provided and includes at least two spaced header and tank constructions and a plurality of flattened tubes extending in parallel between the header and tank constructions and in fluid communication with the interiors thereof. Fins extend between adjacent ones of the flattened tubes and a refrigerant inlet having an inlet port in one of the header and tank constructions is located intermediate the ends thereof and has oppositely directed ports aimed in the direction of elongation of the header and tank constructions. According to the invention, the refrigerant inlet is defined by an inlet fixture including a piece of sheet stock which in turn includes a dimple formed therein and which is sized to fit within the inlet port. Two oppositely directed tabs are formed in the dimple to define the oppositely directed ports and a cover for the sheet stock is fitted thereto and defines an inlet passage extending to the dimple.

In a highly preferred embodiment, the dimple is generally semispherical and each said tab has a pair of spaced parallel edges extending toward a side of the dimple and a partial circular edge interconnecting the parallel edges.

In a highly preferred embodiment, the dimple is imperforate between the tabs.

Preferably, the dimple is formed by stamping the sheet stock. The tabs are formed by punches acting on the dimple.

In one embodiment of the invention, one header and tank construction includes a flat surface in which the inlet port is located and the sheet stock piece is generally planar.

According to the invention, the cover is a cap fitted to and sealed against the sheet oppositely of the dimple. The fixture includes means for receiving inlet and outlet lines and connecting them respectively to the dimple and to an outlet port.

Preferably, the cap is a stamped sheet which includes two recesses formed therein which face the planar sheet. One of the recesses extends to the dimple and the other extends to the outlet port.

In one embodiment, the one recess has a relatively wide end at the dimple and an opposite wide end. This one recess is of diminished cross-section between the ends and serves to prevent flow separation of the inlet stream.

According to still another facet of the invention, there is provided an evaporator for a refrigerant that has at least two spaced, elongated header and tank constructions. A plurality of flattened tubes extend in parallel between the header and tank constructions and are in fluid communication with the interior thereof. Fins extend between adjacent ones in the tubes and an inlet port is disposed in one of the header and tank constructions. A refrigerant distributor is located in the inlet port and an inlet passage has one end extending to the distributor. A connector is located at the other end of the passage for connection to an incoming stream of refrigerant. The passage has a diminishing or converging cross-section from the one end to the other end and a diverging cross-section at the one end.

In a preferred embodiment, the passage is curved intermediate its ends.

In one embodiment, the passage is defined by two plates bonded and sealed to one another. One of the plates is of generally planar construction and mounts the distributor. The other of the plates, on the side thereof facing the one plate, has a recess formed therein. The recess together with the one plate defines the passage.

Preferably, the distributor is stamped in the one plate to extend from the side thereof opposite the other plate.

According to still another facet in the invention, there is provided an evaporator for a refrigerant and including at least two adjacent cores, each having a row of parallel tubes extending between two header and tank constructions. An inlet is located in one of the header and tank constructions and an outlet is located in the other of the header and tank constructions and a cross-over passage is located between two of the headers. A cross-over passage conducts refrigerant from the upstream most one of the two header and tank constructions to the downstream most one of the two header and tank constructions and directs the refrigerant into the downstream most header and tank construction in a direction generally parallel to the tubes.

In a highly preferred embodiment, the cross-over passage conducts the refrigerant through a nominal 180° bend.

In a highly preferred embodiment, the cross-over passage conducts the refrigerant in two separate streams whereby the profile of the cross-over passage may be reduced without reducing the free flow area through the cross-over passage.

In another embodiment an elongated semi-hemispherical passage conducts the refrigerant in a single stream through the crossover passage.

Other objects and advantages will become apparent from the following specification taken in connection with the accompanying drawings.

DESCRIPTION OF THE DRAWINGS

FIG. 1 is a front elevation of a parallel flow evaporator made according to the invention;

FIG. 2 is a side elevation of the evaporator taken from the left of FIG. 1;

FIG. 3 is a plan view of the evaporator;

DESCRIPTION OF THE PREFERRED EMBODIMENT

Figure 4:
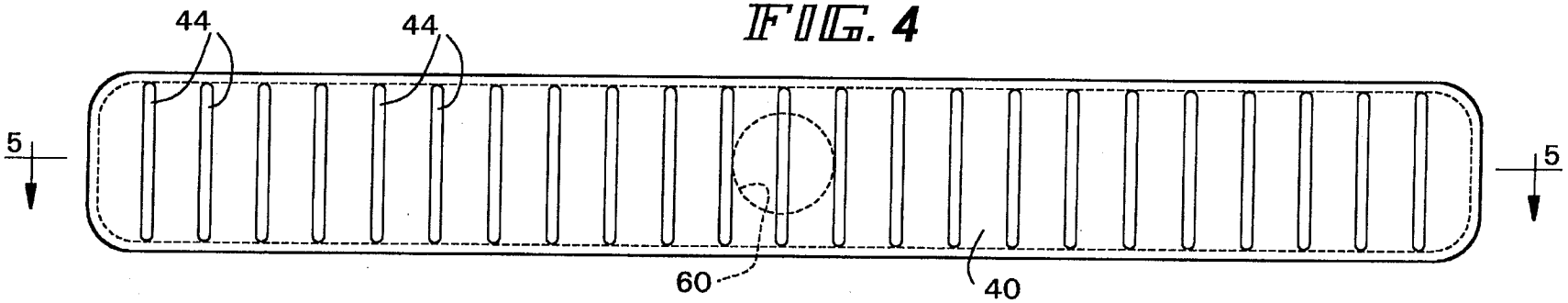
FIG. 4 is a view of a header and tank construction.

An evaporator made according to the invention is illustrated in the drawings and with reference to FIGS. 1–3, inclusive, thereof, is seen to include two identical modules, generally designated 10 and 12 in side by side relation such that they are contacting or almost contacting. The two modules 10, 12 include a total of four header and tank constructions, generally designated 14, 16, 18 and 20. The header and tank constructions 14, 16, 18 and 20 are all identical one to the other. Elongated, flattened tubes 22 extend in parallel between the header and tank constructions 14, 16; 18, 20 of each module 10, 12 and are in fluid communication with the interiors thereof as will be seen. The tubes 22 are identical one to another and typically will either be extruded tubes or fabricated tubes having multiple internal passages of relatively small hydraulic diameter, that is, up to about 0.07". Hydraulic diameter is as conventionally defined.

Identical side pieces 24 interconnect the header and tank constructions 14, 16 and 18, 20 of each module 10 and 12 of both sides thereof. Serpentine fins 26 extend between adjacent ones of the tubes 22 and between the side pieces 24 and an adjacent tube 22 and are bonded thereto.

A cross-over fixture, generally designated 30, interconnects and places the header and tank constructions 14 and 18 in fluid communication with one another. The lower header and tank constructions 16 and 20 serve as inlet and outlet header and tank construction respectively. An inlet/outlet fixture, generally designated 32, is mounted on the header and tank constructions 16 and 20 and establishes a connection of a conduit 34 to the inlet header and tank construction 16. The conduit 34 is adapted to receive refrigerant from a source thereof. Typically, the conduit 34 will be connected to the outlet side of an expansion valve or capillary of a conventional construction as is typically employed in a refrigeration system.

The inlet/outlet fixture 32 also establishes fluid communication between a conduit 36 and the outlet header and tank construction 20. The conduit 36 will ultimately be connected to the suction side of the system compressor to deliver refrigerant in the vapor phase thereto. Typically, the vapor will be somewhat superheated.

Figure 5:
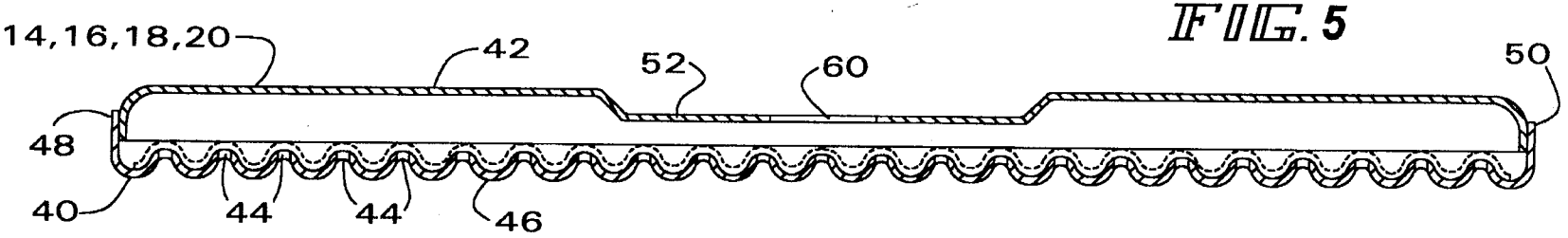
FIG. 5 is a sectional view taken approximately along the line 5—5 in FIG. 4.

Turning now to FIGS. 4 and 5, the header and tank constructions 14, 16, 18 and 20 will be described. Firstly, it should be understood that each is identical to the other so as to minimize the number of parts required to make the evaporator.

Essentially, each header and tank construction 14, 16, 18 and 20 is made of two components. The first is an elongated header plate 40 and the second is a tank 42. The header plate 40 includes a plurality of elongated slots 44 along its length as best seen in FIG. 4. The slots 44 sealingly receive the ends of the flattened tubes 22 as is well known.

As seen in FIG. 5, between each of the slots 44 there is located a pressure dome 46. As can be seen in FIG. 2, each header plate 40 has a curved appearance when viewed at right angles to the view taken in FIG. 5. Thus, each of the pressure domes 46 is formed as a compound curve to provide improved resistance to pressure caused deformation that might cause cracking or rupturing of the joints between the tubes 22 and the header plates 40. The construction is generally as described and commonly assigned U.S. Pat. No. 4,615,385 issued Oct. 7, 1986 to Saperstein, et al., the details of which are herein incorporated by reference.

Each header plate 40 includes a peripheral flange 48 and the tank 42 is nested within the flange 48. The tank 42 also includes a peripheral flange 50 which is sized to fit snugly within the flange 48 so that the interface of the two flanges 48 and 50 may be sealed by a brazing operation or the like.

Centrally of the tank 42, from the standpoint of both its sides and its ends, is a recessed flat surface 52. On either side of the flat surface 52, the tank 42 is somewhat crowned as can be seen at 54 in FIG. 2.

Exactly centrally of each of the recessed flat surfaces 52 is a port 60. The port 60 is circular in configuration and essentially lies in a plane that is parallel to the nominal plane of the header plate 40.

Figure 7:
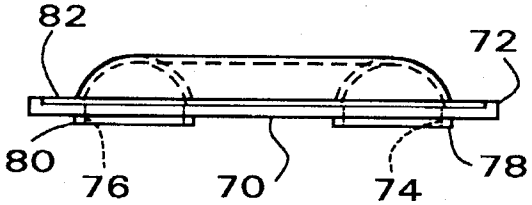
FIG. 7 is a side elevation of the cross-over fixture.
Figure 6:
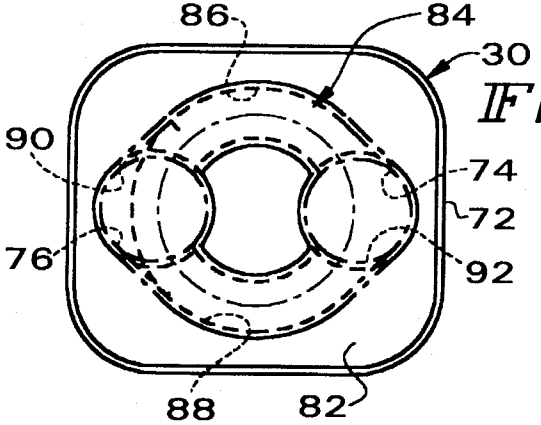
FIG. 6 is a plan view of a cross-over fixture.

FIGS. 6 and 7 illustrate the cross-over fixture 30 in greater detail. As can be seen in FIG. 7, the same includes a flat or planar plate 70 having a peripheral, upturned flange 72. The plate 70 includes first and second identical openings 74, 76 which in turn are surrounded by peripheral flanges 78 and 80. The opening 74, 76 are circular as are the flanges. The flanges 78 and 80 are used to locate the plate 70 in the ports 60 of the tanks 42. The fit is a loose one. The loose fit is such that conventional brazing of the outer surface of the plate 70 to the surface 52 of the tanks 42 will generate a seal thereat.

From FIG. 6, it can be appreciated that the plate 70 is symmetrical about a line drawn through the centers of the openings 74, 76.

The cross-over fixture 30 is completed by a second plate 82, which is nested within the upturned flange 72 of the plate 70 and sealed thereto by brazing. A downwardly facing, generally "0" shaped recess is formed in the plate 82 to define a cross-over passage extending between the openings 74 and 76. As seen in FIG. 6, the recess is generally designated 84 and includes an arcuate upper segment 86 and an arcuate lower segment 88 which are connected to one another at respective ends by hemispherical formations 90 and 92 which are located so as to overlie the openings 74 and 76.

Thus, the cross-over passage defined by the recess 84 has two branches. The purpose of this configuration along with the purpose of recessing the flat surfaces 52 on each of the tanks 42 is to reduce the profile of the evaporator so as to minimize the space required for it under the dash of an automobile or the like, or in any other installation where it may be used. More particularly, by utilizing two, low profile passage segments 86, 88, the same free flow area between the openings 74, 76 may be obtained with a recess 84 of lesser depth.

Figure 8:
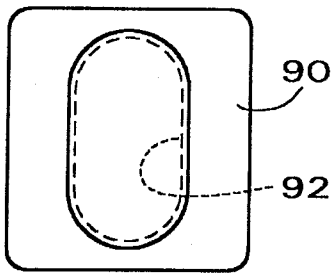
FIG. 8 is a plan view of part of a modified embodiment of a crossover fixture.
Figure 9:
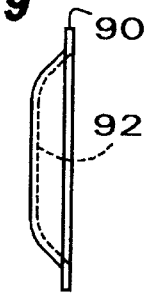
FIG. 9 is a side elevation of the part of FIG. 8.

FIGS. 8 and 9 show a part of a modified embodiment of a crossover fixture wherein the refrigerant crosses over as a single stream. A plate 90 corresponding to the plate 82 includes an elongated, semi-hemispherical recess 92 through which the refrigerant may flow. The plate 90 is sealed to the plate 70 (FIGS. 6 and 7) by brazing just as the plate 82.

As can be ascertained from the geometry of the components as described in FIGS. 1–3, boiling refrigerant is first introduced into the header and tank construction 16 from which it flows through the tubes 22 to the header and tank construction 14. At that point, it will utilize the cross-over fixture 30, flow to the header and tank construction 18 and then return through tubes 22 of the module 12 to the inlet/outlet fixture 32 and the conduit 36. The configuration of the cross-over fixture 30 illustrated ensures that the refrigerant, as it passes from the header and tank construction 14 to the header and tank construction 18, undergoes a change in direction of travel of a nominal 180°. It also insures that the incoming refrigerant directed into the header and tank construction 18 enters in the nominal direction of elongation of the tubes 22, that is, nominally at right angles to the plane of the header plate 40 of the header and tank construction 18. It has been determined that greater uniformity of refrigerant flow, and thus, greater efficiency of the evaporator operation, can be achieved by directing incoming refrigerant between passes in the direction of elongation of the tubes 22; and this is a feature of the present invention.

Figure 10:
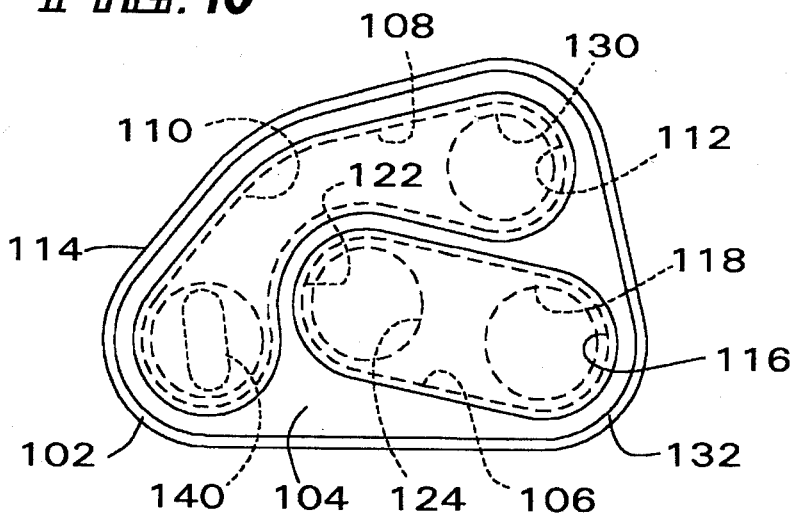
FIG. 10 is an upwardly looking plan view of an inlet/outlet fixture.
Figure 11:
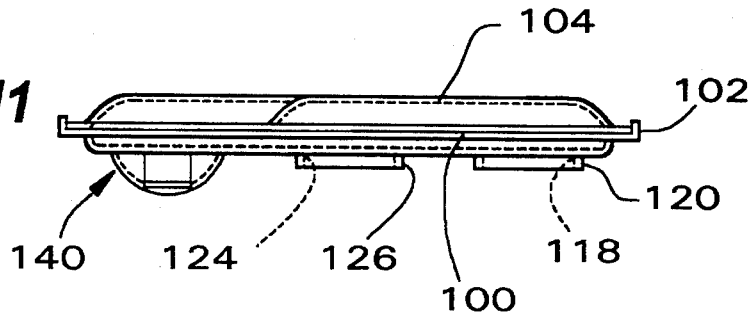
FIG. 11 is an inverted, side elevation of the inlet/outlet fixture.

The inlet/outlet fixture 32 is illustrated in FIGS. 10 and 11 and is seen to include a generally flat or planar plate 100 provided with a peripheral flange 102. A cover plate 104 is nested within the flange 102 and is sealed thereto as by a brazing operation.

The plate 104 has two downwardly opening recesses 106 and 108 stamped in it. Both of the recesses 106 and 108 are elongated and the recess 106 is of uniform cross-section along its length. Conversely, the recess 108 converges as shown in the area marked 110 as one progresses from an end 112 of the recess 108 toward the opposite end 114. The recess 108 enlarges or has diverging walls at or approaching the end 114. The converging-diverging configuration of the recess 108, minimize flow separation in the incoming refrigerant to improve efficiency.

It will also be appreciated that the recess 106 is straight while the recess 108 is curved.

The plate 100, at a location aligned with an end 116 of the recess 106, includes a circular opening 118 surrounded by a peripheral flange 120. The opening 118 is a connector adapted to receive an end of the conduit 36.

The opposite end 122 of the recess 106 overlies a circular opening 124 having a circular peripheral flange 126. The outer diameter of the flange 126 is about equal to the inner diameter of the port 60 so as to be receivable in the port 60 associated with the tank 42 in the header and tank construction 20 of the module 12 and be sealingly brazed thereto.

The plate 100, at a location underlying the end 112 of the recess 108, includes a circular opening 130 surrounded by a peripheral flange 132 (FIG. 1) which acts as a connector for receipt of the inlet conduit 34.

The plate 100, at a location underlying the opposite end 114 of the recess 108 includes a distributor, generally designated 140.

Figure 12:
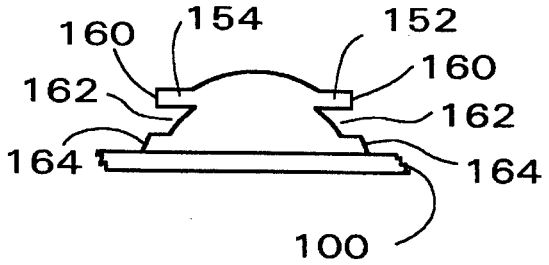
FIG. 12 is an enlarged, fragmentary view of a distributor.
Figure 13:
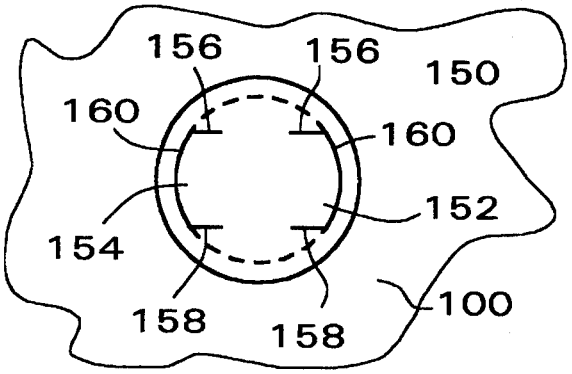
FIG. 13 is a plan view of the distributor.
Figure 14:
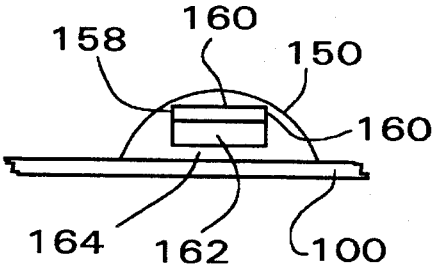
FIG. 14 is a view of the distributor taken approximately 90° from the view illustrated in FIG. 12.

The distributor 140 is illustrated in enlarged detail in FIGS. 12, 13, and 14. The same is basically in the form of a hemispherical dimple 150 formed in the plate 100 by stamping. Where the hemispherical dimple 150 merges with the plane of the plate 100, the diameter of the dimple 150 is slightly less than the inner diameter of the port 60 in a tank 42 so that the dimple 150 may freely enter the port 60 in the tank 42 forming part of the header and tank construction 16.

The dimple 150 may be formed by stamping. It is also provided with two oppositely directed tabs 152 and 154. The orientation of the tabs 152 and 154 is such that they are directed in the direction of elongation of the header and tank construction 16. As can be seen in FIG. 13, each of the tabs 152 and 154 has a pair of parallel side edges 156 and 158 connected by a curved edge 160. The dimple 150 is imperforate between the tabs 152 and 154. The result is to generate a relatively rectangular opening 162 beneath each tab 152 and 154. It will also be observed that the dimple 150 remains intact beneath the openings 162 in the area designated 164, generally for a distance equal approximately to the thickness of the tank 42.

In some instances, it may be desirable to not only employ the dimple 140 in the inlet to the module 10, but in the crossover inlet to the module 12 as well. In such a case the distributor 140 as described can be formed in the plate 70 (FIG. 7) at the appropriate one of the openings 74 or 76.

Preferably, all components are made of aluminum and where surfaces are to be joined and/or sealed, one or the other or both of such surfaces will be braze clad. The evaporator lends itself to an assembly operation including brazing by the so called Nocolok® brazing process.

In the usual case, the assembled evaporator will have a core depth on the order of about two inches or less, considerably less than conventional evaporators, thereby providing a substantial volume savings. Moreover, the small size of the evaporator of the invention means a material savings and a weight savings as well. The latter, in automotive installations, translates to an energy saving by reason of weight reduction. Similarly, the relatively small core depth provides an energy savings and/or enables the use of a smaller fan and/or enables operation at an increased efficiency.

The use of identical components in many locations minimizes the number of different parts required. Thus, the evaporator requires one type of tank 42, one type of header plate 40, one type of tube 22, one type of serpentine fin 26, one type of side piece 24, a two piece cross-over fixture 30 and a two piece inlet/outlet fixture 32, for a total of only nine components of differing geometry.

Furthermore, by locating the ports 60 at the center of the tanks 42, the various modules 10 and 12 may be assembled together in any orientation because the fixtures 30, 32 are configured to connect to any two adjacent tanks. This feature minimizes the possibility of human error in the assembly process because it is virtually impossible to improperly assemble the components together unless one omits a part altogether.

The unique cross-over fixture 30 provides an increase in efficiency by directing refrigerant from an upstream core or module to a downstream core or module such that the refrigerant enters the latter in a direction nominally parallel to the tubes for uniform distribution.

In addition, the dual passage configuration provides a reduction in profile of the entire apparatus.

The inlet/outlet fixture 32 provides a number of advantages. The distributor formed by the tabs 152 and 154 in the dimple 150 provides an inexpensive, but highly efficient distributor to increase efficiency of the evaporation procedure. Because it is formed by stamping and punching in a sheet of metal, its cost is extremely low. Further, the configuration of the recess 108 which converges in the direction away from the connection to the source of refrigerant and then diverges at or approaching the distributor 140 assures that a highly uniform stream of refrigerant is directed to the distributor 140 in spite of the fact that the refrigerant is already boiling and is in part in the vapor phase and in part in the liquid phase.

Consequently, a highly efficient evaporator ideally suited for commercialization is provided.

We claim:

1. A parallel flow evaporator comprising:

a pair of identical heat exchange units;

each unit including a pair of identical, parallel spaced header and tank constructions, each having slots in one side thereof with the slots in one being aligned with the slots in the other; and a plurality of identical, flattened tubes extending in parallel between said header and tank constructions and having their ends received in aligned ones of the slots and bonded to the header and tank constructions of the corresponding unit; said header and tank constructions each having an identical, generally central flat surface on a side thereof remote from said slots, and identical, generally centrally located ports in said flat surfaces, said units being disposed in side by side relation with corresponding header and tank constructions being in contacting or almost contacting relation;

fins extending between adjacent tubes in said units;

an inlet/outlet fixture bonded to the flat surfaces of one pair of header and tank constructions defined by adjacent header and tank constructions of both said units and having an inlet port in fluid communication with one of said identical ports in said one pair of header and tank constructions and an outlet port in fluid communication with the other of said identical ports in said one pair of header and tank constructions; and a cross-over fixture bonded to flat surfaces of the other pair of header and tank constructions defined by the remaining header and tank constructions of both said units, and having a first port in fluid communication with one of the identical ports in said other pair, a second port in fluid communication with the other of the identical ports in said other pair, and a fluid passage interconnecting said first and second ports.

2. The evaporator of claim 1 wherein said cross-over fixture is constructed so that said first and second ports are generally parallel to the adjacent ones of the headers bonded to the header and tank constructions in said other pair so that a heat exchange fluid emanating from either said first or second port will be flowing to impinge at a nominal right angle on the associated header.

3. A parallel flow evaporator comprising:

a pair of identical heat exchange units;

each unit including a pair of identical, parallel spaced header and tank constructions, each having slots in one side thereof with the slots in one being aligned with the slots in the other; and a plurality of identical flattened tubes extending generally vertically in parallel between said header and tank constructions and having their ends received in aligned ones of the slots and bonded to the header and tank constructions; said header and tank constructions each having an identical, generally central flat surface on a side thereof remote from said slots and identical, generally centrally located ports in said flat surfaces, said units being disposed in side by side relation with the header and tank constructions of each of said units being in contacting or almost contacting relation;

first extending between adjacent tubes in said units;

an inlet/outlet fixture bonded to the flat surfaces of one pair of header and tank constructions defined by adjacent header and tank constructions of both said units and having an inlet port in fluid communication with one of said identical ports in said one pair of header and tank constructions and an outlet port in fluid communication with the other of said identical port in said one pair of header and tank constructions; and a cross over fixture bonded to flat surfaces of the other pair of header and tank constructions defined by the remaining header and tank constructions of both said units, and having a first port in fluid communication with one of the identical ports in said other pair, a second port in fluid communication with the other of the identical ports in said other pair, and a fluid passage interconnecting said first and second ports;

one of said inlet/outlet and said crossover fixtures including a sheet metal component having a flat surface abutting said one pair of header and tank constructions, a dimple of a size about that of one of said identical ports or less, formed in said component and located within one of said identical ports in said one pair of header and tank constructions, said dimple including oppositely directed tabs struck from the dimple to define oppositely directed distributor openings.

4. A parallel flow evaporator comprising:

a pair of identical heat exchange units;

each unit including a pair of identical, parallel spaced header and tank constructions, each having slots in one side thereof with the slots in one being aligned with the slots in the other; and a plurality of identical flattened tubes extending generally vertically in parallel between said header and tank constructions and having their ends received in aligned ones of the slots and bonded to the header and tank constructions; said header and tank constructions each having an identical, generally central flat surface on a side thereof remote from said slots, and identical, generally centrally located ports in said flat surfaces, said units being disposed in side by side relation with the header and tank constructions of each of said units being in contacting or almost contacting relation;

fins extending between adjacent tubes in said units;

an inlet/outlet fixture bonded to the flat surfaces of one pair of header and tank constructions defined by adjacent header and tank constructions of both said units and having an inlet port in fluid communication with one of said identical ports in said one pair of header and tank constructions and an outlet port in fluid communication with the other of said identical port in said one pair of header and tank constructions, said inlet/outlet fixture including an inlet port aligned with one of said identical ports in said one pair of header and tank constructions, a further port adapted to be connected to a source of heat exchange fluid, and a passage connected to said inlet port and said further port, said passage having a diminishing cross-section from said further port extending to an increasing cross-section at or just before said inlet port; and a crossover fixture bonded to flat surfaces of the other pair of header and tank constructions defined by the remaining header and tank constructions of both said units, and having a first port in fluid communication with one of the identical ports in said other pair, a second port in fluid communication with the other of the identical ports in said other pair, and a fluid passage interconnecting said first and second ports.

5. A parallel flow evaporator comprising:

a pair of identical units;

each unit including a pair of identical, parallel spaced elongated header and tank constructions, each having slots in one side thereof with the slots in one being aligned with the slots in the other; and a plurality of identical, flattened tubes extending in parallel between said header and tank constructions and having their ends received in aligned ones of the slots and bonded to the header and tank constructions of the corresponding unit; said header and tank constructions each having, intermediate its ends, an identically located recessed, flat surface on a side thereof remote from said slots, and identically located ports in said flat surfaces, said units being disposed in side by side relation with corresponding header and tank constructions being in contacting or almost contacting relation;

fins extending between adjacent tubes in said units;

an inlet/outlet fixture bonded to the recessed flat surfaces of one pair of header and tank constructions defined by adjacent header and tank constructions of both said units and having an inlet port in fluid communication with one of said identical ports in said one pair of header and tank constructions and an outlet port in fluid communication with the other of said identical ports in said one pair of header and tank constructions; and a cross-over fixture bonded to the recessed flat surfaces of the other pair of header and tank constructions defined by the remaining header and tank constructions of both said units, and having a first port in fluid communication with one of the identical ports in said other pair, a second port in fluid communication with the other of the identical ports in said other pair, and a fluid passage interconnecting said first and second ports.

6. The parallel flow evaporator of claim 5 wherein said inlet/outlet fixture is formed of sheet metal.

7. The parallel flow evaporator of claim 5 wherein said cross-over fixture is formed of sheet metal.

8. The parallel flow evaporator of claim 5 wherein both said inlet/outlet fixture and said cross-over fixture are formed of sheet metal.

9. A parallel flow evaporator comprising:

a pair of identical units;

each unit including a pair of identical, parallel spaced header and tank constructions, each having slots in one side thereof with the slots in one being aligned with the slots in the other; and a plurality of identical, flattened tubes extending in parallel between said header and tank constructions and having their ends received in aligned ones of the slots and bonded to the respective header and tank construction of the corresponding unit; said header and tank constructions each having an identically located recessed surface on a side thereof remote from said slots, and an identically located port in said recessed surfaces, said units being disposed in side by side relation with corresponding header and tank constructions being in contacting or almost contacting relation;

fins extending between adjacent tubes in said units;

an inlet/outlet fixture bonded to the recessed surfaces of one pair of header and tank constructions defined by adjacent header and tank constructions of both said units and having an inlet port in fluid communication with one of said identical ports in said one pair of header and tank constructions and an outlet port in fluid communication with the other of said identical ports in said one pair of header and tank constructions; and a cross-over fixture bonded to the recessed surfaces of the other pair of header and tank constructions defined by the remaining header and tank constructions of both said units, and having a first port in fluid communication with one of the identical ports in said other pair, a second port in fluid communication with the other of the identical ports in said other pair, and a fluid passage interconnecting said first and second ports.

10. The parallel flow evaporator of claim 9 wherein said inlet/outlet fixture is formed of sheet metal.

11. The parallel flow evaporator of claim 9 wherein said cross-over fixture is formed of sheet metal.

12. The parallel flow evaporator of claim 9 wherein both said inlet/outlet fixture and said cross-over fixture are formed of sheet metal.

* * * * *